US007401470B2

(12) United States Patent
Lee et al.

(10) Patent No.: US 7,401,470 B2
(45) Date of Patent: Jul. 22, 2008

(54) WATER SUPPLY CONTROL APPARATUS FOR ICE MAKER AND METHOD THEREOF

(75) Inventors: Wook Yong Lee, Incheon-si (KR); Eul Yeop Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 332 days.

(21) Appl. No.: 11/240,482

(22) Filed: Oct. 3, 2005

(65) Prior Publication Data

US 2006/0090485 A1 May 4, 2006

(30) Foreign Application Priority Data

Nov. 2, 2004 (KR) ..... 10-2004-0088427

(51) Int. Cl.
*F25C 1/12* (2006.01)

(52) U.S. Cl. ..... 62/135; 62/233; 62/347

(58) Field of Classification Search ..... 62/135, 62/208, 233, 347
See application file for complete search history.

(56) References Cited

U.S. PATENT DOCUMENTS 3,059,445 A * 10/1962 Kniffin ..... 62/135
4,787,216 A * 11/1988 Chesnut et al. ..... 62/347
4,866,948 A * 9/1989 Cole ..... 62/233
5,212,955 A 5/1993 Hogan
6,679,073 B1 1/2004 Hu
6,705,091 B1 3/2004 Kim et al.
7,051,541 B2 * 5/2006 Chung et al. ..... 62/137
2002/0083726 A1 7/2002 Kim et al.
2004/0177626 A1 9/2004 Hu
2004/0194480 A1 10/2004 Kim et al.
2004/0261442 A1 12/2004 Chung et al.
2005/0056043 A1 3/2005 Lee et al.
2005/0066670 A1 3/2005 Chung et al.
2005/0115266 A1 6/2005 Lim et al.

FOREIGN PATENT DOCUMENTS

GB 2383119 6/2003

* cited by examiner

*Primary Examiner*—William E Tapolcai
(74) *Attorney, Agent, or Firm*—Greenblum & Bernstein, P.L.C.

(57) ABSTRACT

There is provided a water supply control apparatus for an ice maker and method thereof. In the apparatus and method, an ejector pushes out ice, a sensor detecting portion is formed on the ejector, and at least two sensors detect a senor transit time for the sensor detecting portion to travel from one of the sensors to the other. Therefore, an adequate amount of water can be supplied to the ice maker to make ice with a desired size regardless of the variation in the water pressure of a water inlet line from a household water source.

12 Claims, 13 Drawing Sheets

WATER SUPPLY CONTROL APPARATUS FOR ICE MAKER AND METHOD THEREOF

BACKGROUND OF THE INVENTION

1. Field of the Invention

The present invention relates to an ice maker of a refrigerator, and more particularly, to a water supply control apparatus for an ice maker and method thereof. In the apparatus and method, the amount of water supply to the ice maker is properly controlled according to the pressure of the household water source, thereby allowing stable operation of the ice maker.

2. Description of the Related Art

An ice maker is a device for making ice. For home use, some refrigerators are equipped with the ice maker to provide ice, and more refrigerators are being equipped with the ice maker to satisfy user's taste.

The ice maker requires a water inlet line to receive water from a household water source. Other devices such as a water purifier can be interposed between the water inlet line and the household water source. The user can supply water to the ice maker by simply pressing an ice button formed on a predetermined portion of the refrigerator instead of manually supplying the water.

However, the water pressure of the household water source differs from one house to another. Therefore, water supply time cannot be set equally. For example, an ice maker at a high water pressure area may be supplied with large amount of water in a short time to cause overflow, and an ice maker at a low water pressure area such as a hilly section may be supplied with small amount of water though the water is supplied for a relatively long time to result in undesired small-sized ice. To obviate this problem, the water supply time must be adjusted depending on the pressure (speed) of the water in the water inlet line: a short time for a high speed and a long time for a low speed.

According to a related art method for obviating the problem, the size of water passage of the water inlet line is adjusted depending on the water pressure of the household water source when the ice maker is installed for the first time. However, this method has a drawback in that the adjustment work should be repeated when the water pressure is changed for some reason such as when the user moves to a new house.

According to another method, the user can adjust the water supply time to make the ice with a desired size. However, this alternative method is not suitable for users who are not familiar with the ice maker. Also, since the user does not know the approximate ice size for the ice maker, it is hard for the user to adjust the water supply time.

Therefore, there is a need for an apparatus and method that can automatically adjust the amount of water supply to the ice maker.

SUMMARY OF THE INVENTION

Accordingly, the present invention is directed to a water supply control apparatus for an ice maker and method thereof that substantially obviates one or more problems due to limitations and disadvantages of the related art.

An object of the present invention is to provide a water supply control apparatus for an ice maker and method thereof that is capable of automatically control the amount of water supply to the ice maker.

Another object of the present invention is to provide a water supply control apparatus for an ice maker and method thereof that provide a way of readjusting the amount of water supply to the ice maker when a user wanted.

A further another object of the present invention is to provide a water supply control apparatus for an ice maker and method thereof that provides the ice maker with an adequate amount of water according to the capacity of the ice maker.

A still further another object of the present invention to provide a water supply control apparatus for an ice maker and method thereof that enables the ice maker to make high quality ice by adjusting the amount of water supply according to the capacity of the ice maker.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a water supply control apparatus for an ice maker includes: an ice making portion in which ice is made; an ejector rotatably installed to eject the ice; at least one pair of sensors detecting the angle of the ejector; and a controller controlling the amount of water supply to the ice making portion in accordance with a sensor transit time necessary for the ejector to pass the distance between the pair of sensors.

In another aspect of the present invention, a water supply control apparatus for an ice maker includes: an ice ejection controller including at least one ejector to push ice; an ejector position sensor including at least two sensors to detect the rotation position of the ejector; a water supply adjustor adjusting the amount of water supply to the ice maker; and a controller determining whether a stall situation occurs when the ejector operates by using a sensor transit time for the ejector to move from one of the two sensors to the other, and the controller controlling the water supply adjustor to reduce the amount of the water supply when the stall situation occurs and to increase the amount of the water supply when the stall situation does not occur.

In a further another aspect of the present invention, a water supply control method for an ice maker includes: when ejecting ice by rotating an ejector, comparing a first time necessary for the ejector to actually rotate to eject the ice once and a second time that is previously set; and repeating an ice making operation and the ice ejecting operation after reducing the amount of water supply in a first condition when the first time is longer than the second time or after increasing the amount of the water supply in a second condition when the first time is not longer than the second time.

In a still further another aspect of the present invention, a water supply control method for an ice maker includes: when ejecting ice by rotating an ejector after making the ice, comparing a first time necessary for the ejector to actually rotate to eject the ice once and a second time that is previously set; determining whether the sing of a subtraction value obtained by subtracting the second time from the first time is changed when compared with the sign of the preceding subtraction value; and fixing a current water supply time if the subtraction value is changed, reducing the amount of water supply if the subtraction value is not changed and the fist time is longer than the second time, and increasing the amount of the water supply if the subtraction value is not changed and the first time is not longer than the second time.

According to the present invention, the amount of the water supply to the ice maker can be automatically adjusted. Particularly, the adjustment is carried out in accordance with the type of the ice maker to allow optimized operation of the ice maker.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
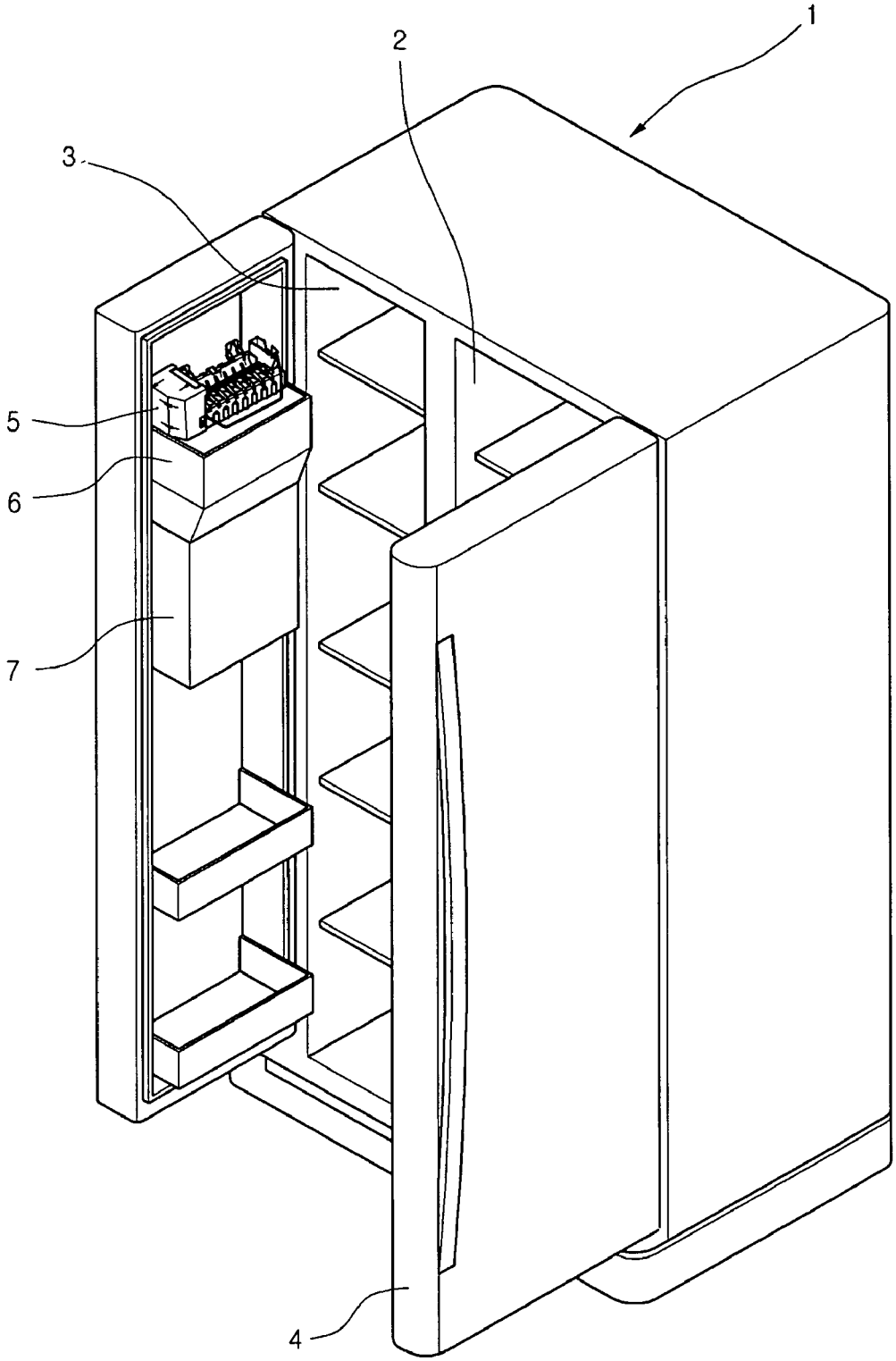
FIG. 1 is a perspective view of a refrigerator according to the present invention.

FIG. 1 is a perspective view of a refrigerator according to the present invention.

Referring to FIG. 1, a refrigerator 1 which is used for keeping food cool includes a chilling chamber 2 in which food is kept at a low temperature above zero degrees Celsius, a freezing chamber 3 in which food such as ice is kept at a low temperature below zero degrees Celsius, an ice maker 5 accommodated in the freezing chamber 3 for making ice, an ice bank 6 in which the ice made by the ice maker 5 is stored, and an ice dispenser 7 from which a user can take out the ice stored in the ice bank 6.

Though not shown, the refrigerator 1 also includes a compressor, a condenser, an expansion valve, and an evaporator that are used for refrigeration cycle.

In operation of the ice maker 5, a proper amount of water is supplied to the ice maker 5 and cooling air is supplied to the ice maker 5. When the water in the ice maker 5 is frozen by the cooling, the ice maker 5 ejects and drops the ice to the ice bank 6 to store it. A user can take out the ice as much as he/she want from the ice bank 6 through the ice dispenser 7.

Figure 2:
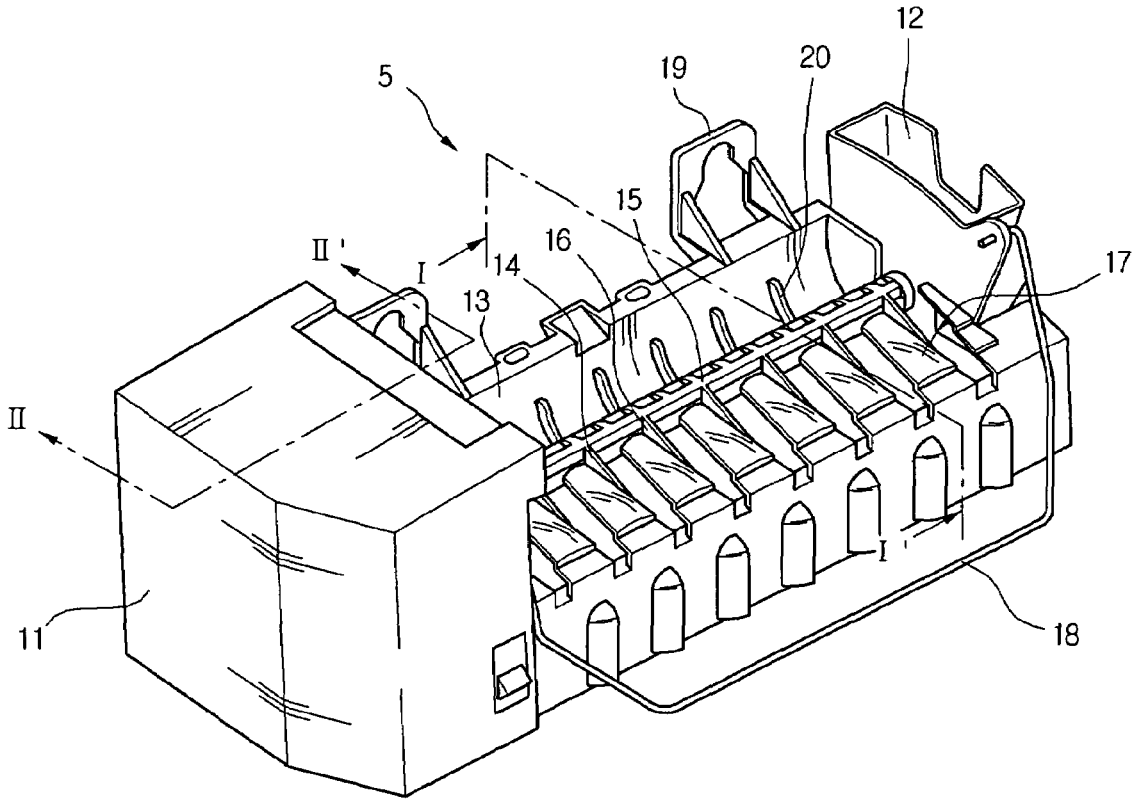
FIG. 2 is a perspective view of an ice maker according to the present invention.
Figure 3:
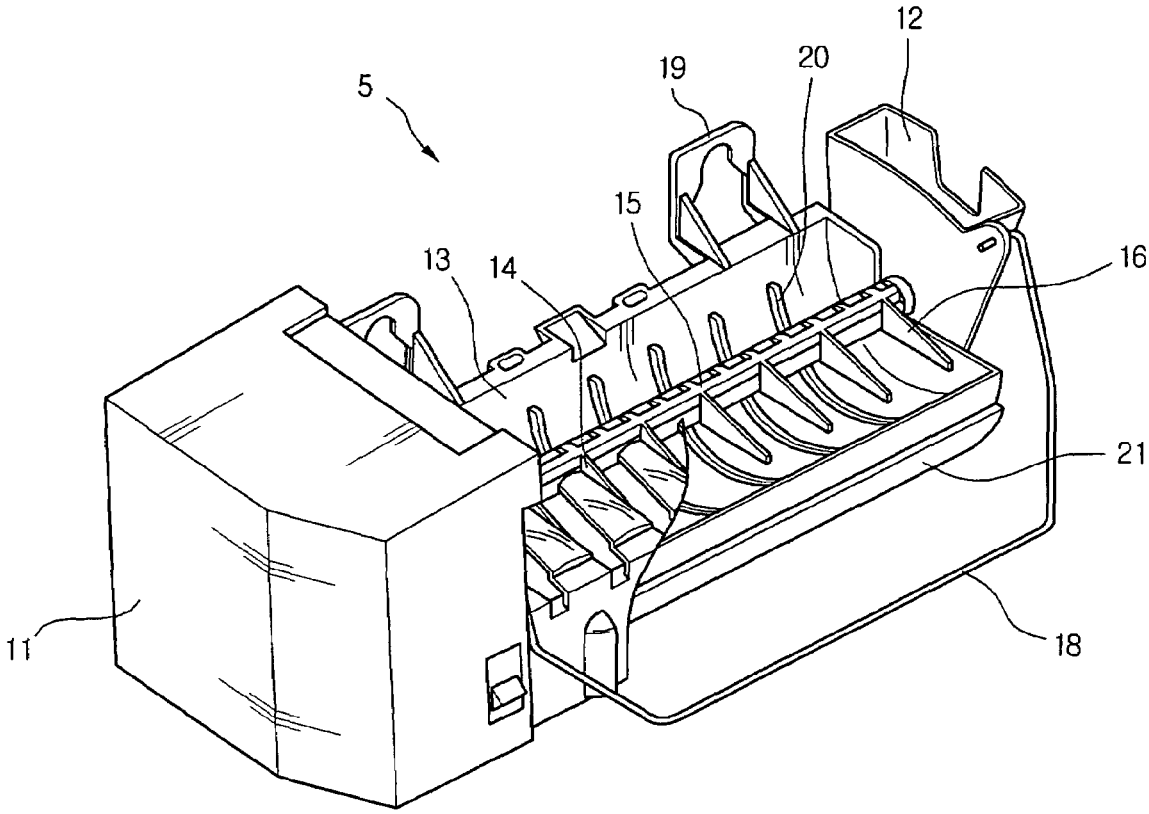
FIG. 3 is a cut-away view of an ice maker according to the present invention.

FIG. 2 is a perspective view of an ice maker according to the present invention, and FIG. 3 is a cut-away view of an ice maker according to the present invention.

Referring to FIGS. 2 and 3, the ice maker 5 includes a water supply unit 12 to draw in water from outside source, an ice making portion 13 in which water is frozen, an ejector 14 to eject the ice from the ice making portion 13, and a control box 11 in which a plurality of components are disposed to rotate the ejector 14. Also, the ice maker 5 includes mounting portions 19 at its back for coupling with the refrigerator 1 and an ice-overflow sensing lever 18.

In detail, the ejector 14 includes an axle 15 rotatably extended beside the control box 11 and axially arranged fingers 16 extended from the axle 15 to push out the ice as the axle 15 rotates. The ice making portion 13 includes compartment protrusions 20 to compartment the inside space of the ice making portion 13 into a plurality of small spaces to make the ice with a desired size. Above the ice making portion 13, a separator 17 is provided to guide the ice pushed up by the ejector 14 down to the ice bank 6. Under the ice making portion 13, a heater 21 is provided to heat the ice making portion 13 to separate the ice from the surface of the ice making portion 13.

An operation of the ice maker 5 will now be described in association with the above-mentioned structure.

Water is filled in the water supply unit 12 from a water inlet line. The water is supplied to the ice making portion 13 to fill the separated spaces formed by the compartment protrusions 20. Then, the water is frozen by a cooling air of which temperature is below zero degrees Celsius.

After the water in the ice making portion 13 is completely frozen, a driving device in the control box 11 activates the ejector 14. In detail, as the axle 15 rotates the fingers 16 push up the ice along the inner surface of the ice making portion 13. Before the fingers 16 push up the ice, the heater 21 applies heat to the ice making portion 13 to slightly melt the ice to release it.

After the ice is pushed up by the ejector 14, the separator 17 guides the ice down to the ice bank 6 to store it.

This operation is repeated to fully fill the ice bank 6 with the ice. When the ice-overflow sensing lever 18 detects the fully filled state of the ice bank 6, the operation of the ice maker 5 is suspended.

Figure 4:
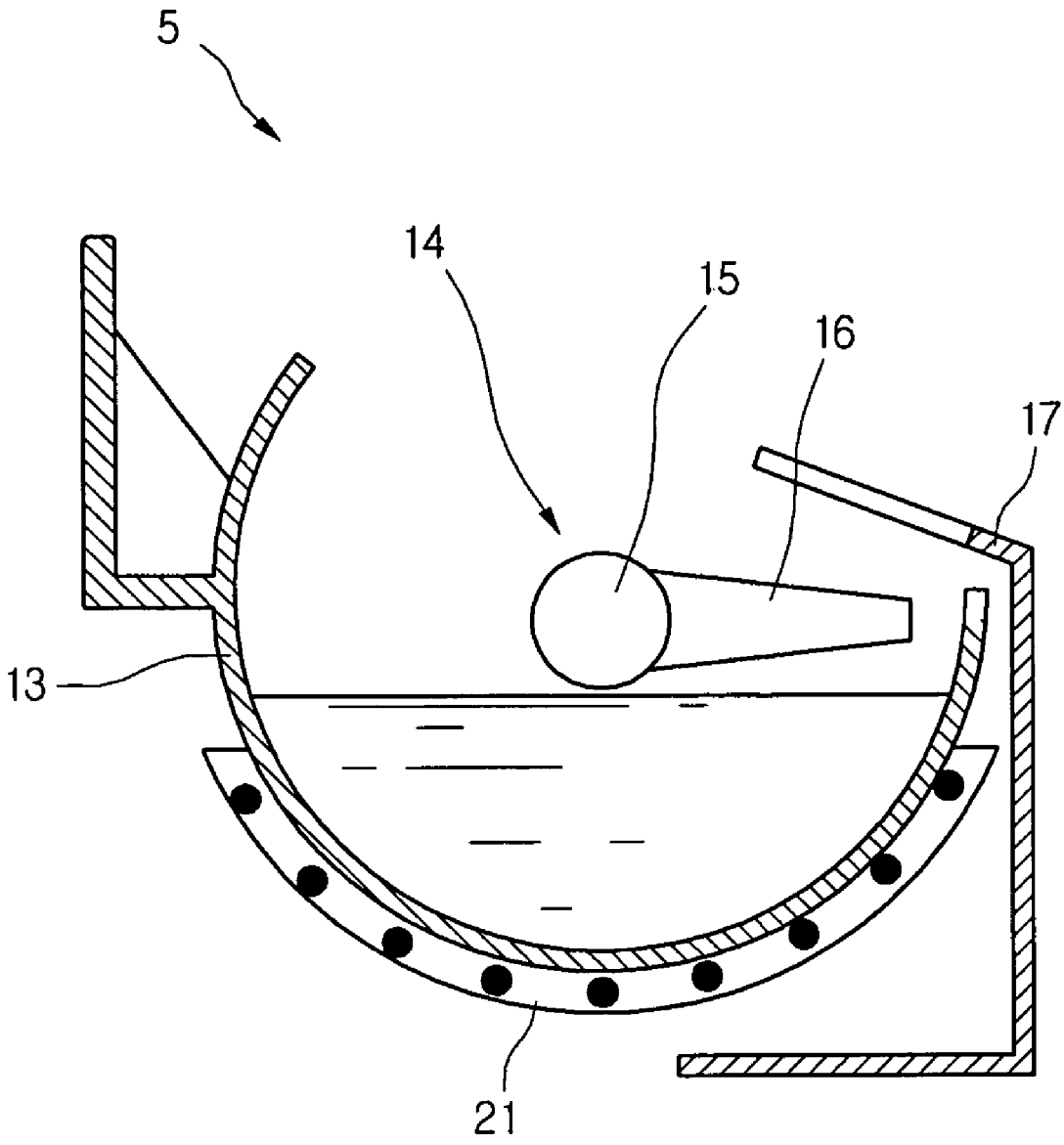
FIG. 4 is a sectional view taken along line I-I' of FIG. 2.

FIG. 4 is a sectional view taken along line I-I' of FIG. 2. The operation of the ice maker 5 can be clearly understood with reference to FIG. 4.

Referring to FIG. 4, when the ice making portion 13 is supplied with water, cooling air is supplied to the ice making portion 13 to freeze the water. After the water is completely frozen, the heater 21 applies heat to the ice making portion 13 to slightly melt the ice to release it from the ice making portion 13. Since the ice becomes movable on the surface of the ice making portion 13 owing to the heating of the heater 21, the ice is easily pushed up by the finger 16 when the axle 15 is rotated clockwise. The pushed-up ice is guided by the separator 17 down to the ice bank 6.

In the operation of the ice maker 5, the amount of water supply to the ice maker 5 can be properly controlled according to the present invention. A water supply control apparatus of the present invention will now be described in detail.

Figure 5:
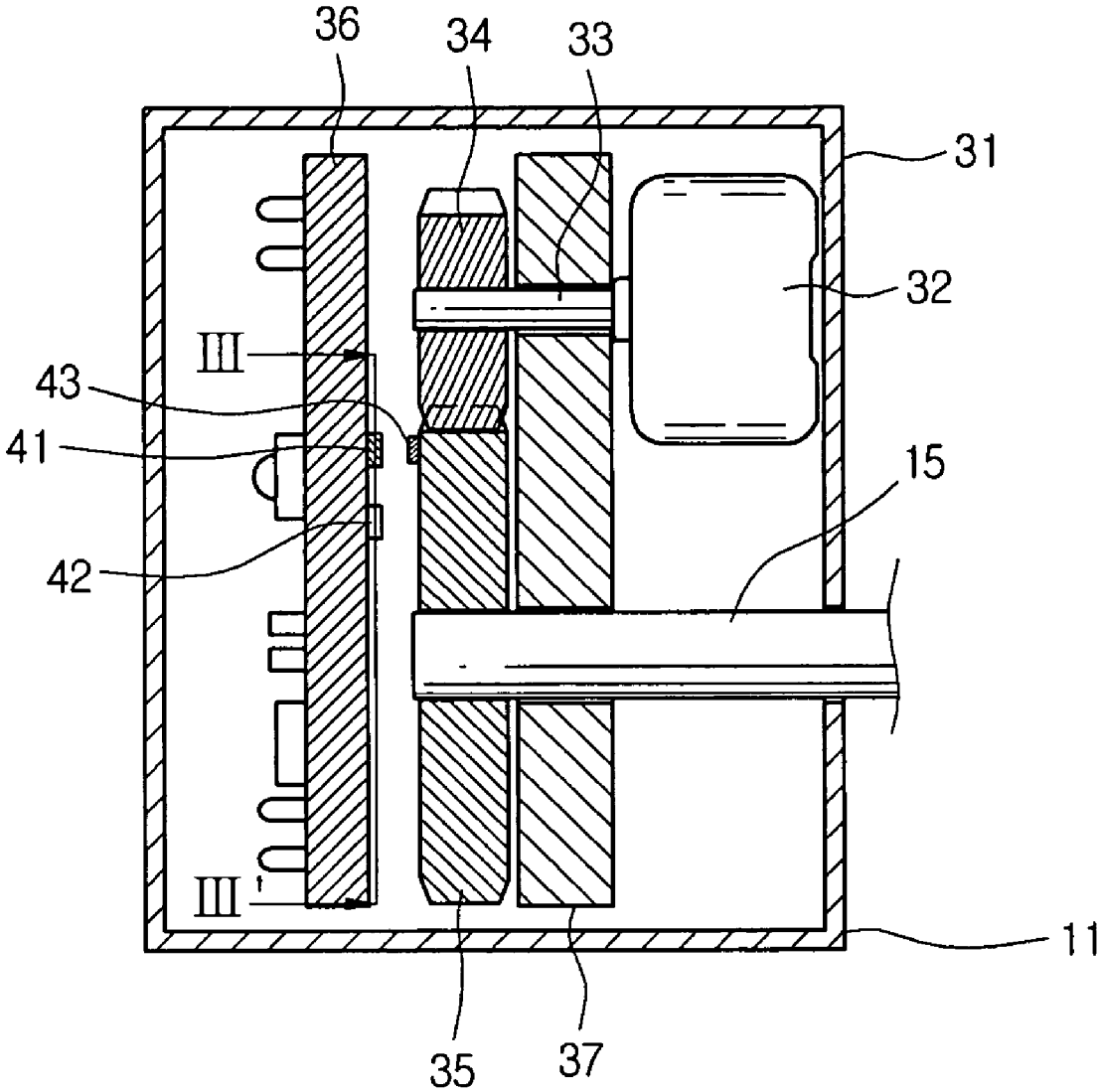
FIG. 5 is a sectional view taken along line II-II' of FIG. 2.
Figure 6:
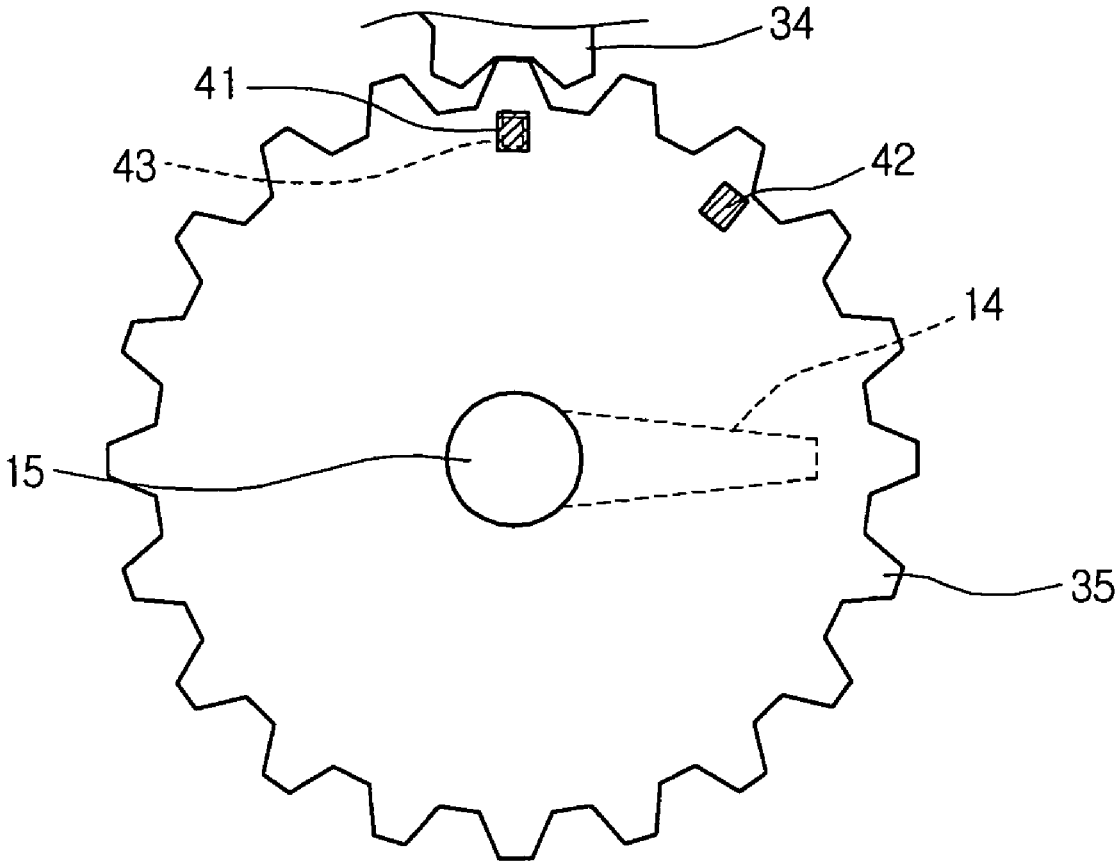
FIG. 6 is a sectional view taken along line III-III' of FIG. 5.

FIG. 5 is a sectional view taken along line II-II' of FIG. 2, and FIG. 6 is a sectional view taken along line III-III' of FIG. 5.

Referring to FIGS. 5 and 6, the control box 11 includes a motor 32 to drive the axle 15 to push up the ice, a motor shaft 33 extending from one side of the motor 32, a driving gear 34 fixed to the motor shaft 33, and an ejector gear 35 meshed with the driving gear 34. The ejector gear 35 is fixed to an end of the axle 15, such that the axle 15 can be rotated to push up the ice when the ejector gear 35 is rotated by the driving gear 34.

Also, the control box 11 includes a control panel 36 and a mounting panel 37. The control panel 36 includes a plurality of components such as a micro computer to control the operation of the ice maker 5, and the mounting panel supports the motor 32, the driving gear 34, and the ejector gear 35. Specifically, the control panel 36 is provided with a plurality of sensors such as a first sensor 41 and a second sensor 42, and the ejector gear 35 is formed with a sensor detecting portion 43. The first and second sensors 41 and 42 are fixed to the control panel 36 without movement, and the sensor detecting portion 43 rotates together with the ejector gear 35. Therefore, the rotation angle of the ejector gear 35 and the axle 15 can be detected by the sensors 41 and 42.

The sensor detecting portion 43 may be formed at other location where it can be rotated together with the axle 15 instead of locating it at the ejector gear 35. Also, the sensors 41 and 42 may be fixed to other location where it can be non-movably positioned with respect to the axle 15 instead of locating it at the control panel 36. In other words, either the sensors 41 and 42 or the sensor detecting portion 43 is located at a fixed position and the other(s) is located at a position where it can be rotated together with the axle 15.

Since the sensor detecting portion 43 and the sensors 41 and 42 are located in this relationship, the rotation angle of the ejector 14 can be detected using the sensors 41 and 42. For example, the sensor detecting portion 43 may be formed with magnet and the sensors 41 and 42 may be hole sensors. When the magnet portion passes by each hole sensor, the hole sensor detects the magnet portion. The sensors 41 and 42 generate sensor signals when they detect the sensor detecting portion and send the signals to a controller of the ice maker 5 for control operation.

The positions of the ejector 14, which can be detected using the sensor detecting portion 43 and the sensors 41 and 42, can be classified into three: a first position (initial position), a second position at which the ice is not separated from the surface of the ice making portion 13, and a third position at which the ice is completely separated from the surface of the ice making portion 13.

Figure 7:
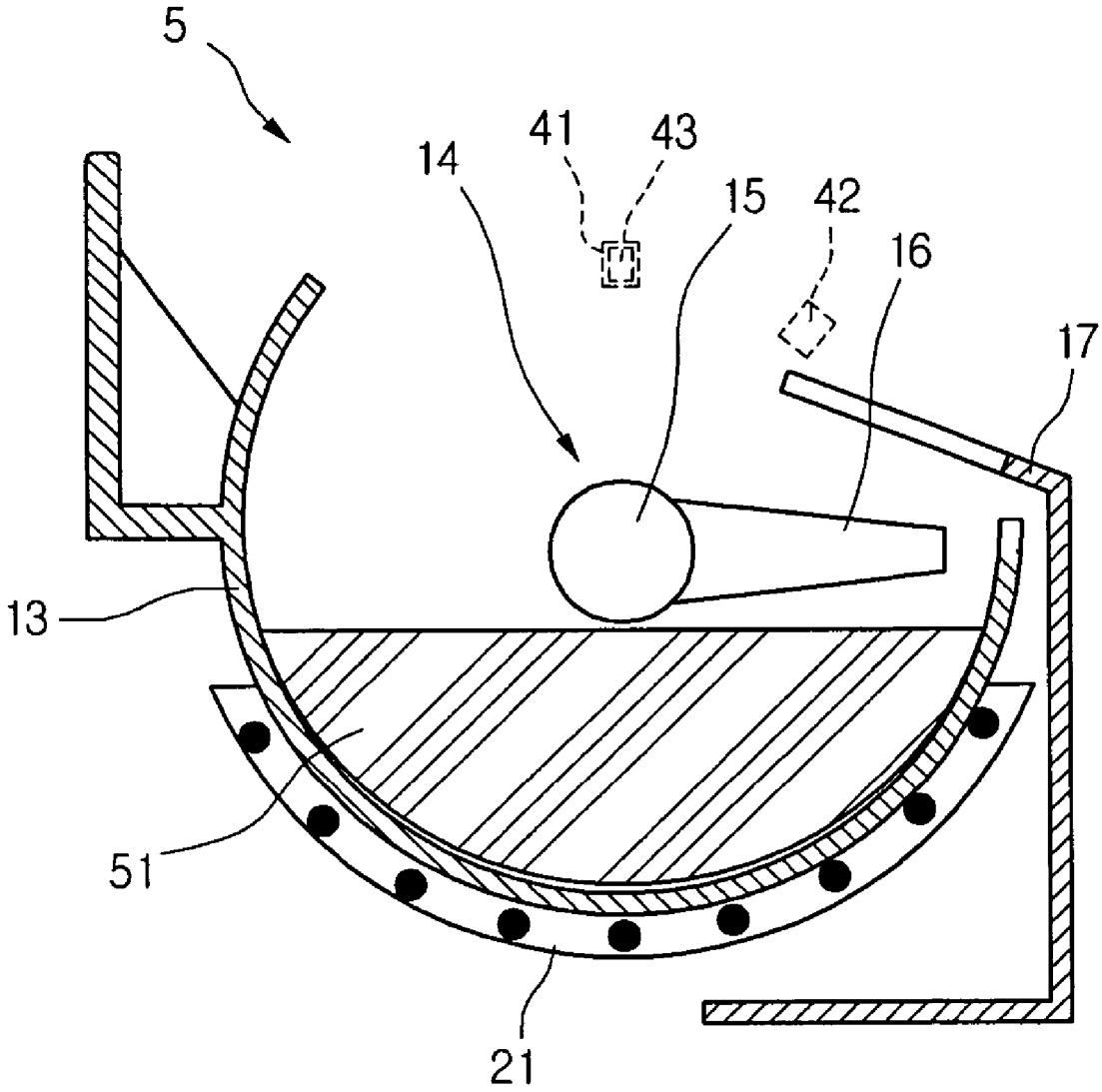
FIG. 7 is a sectional view showing an early stage of ice making operation in an ice maker according to the present invention.
Figure 8:
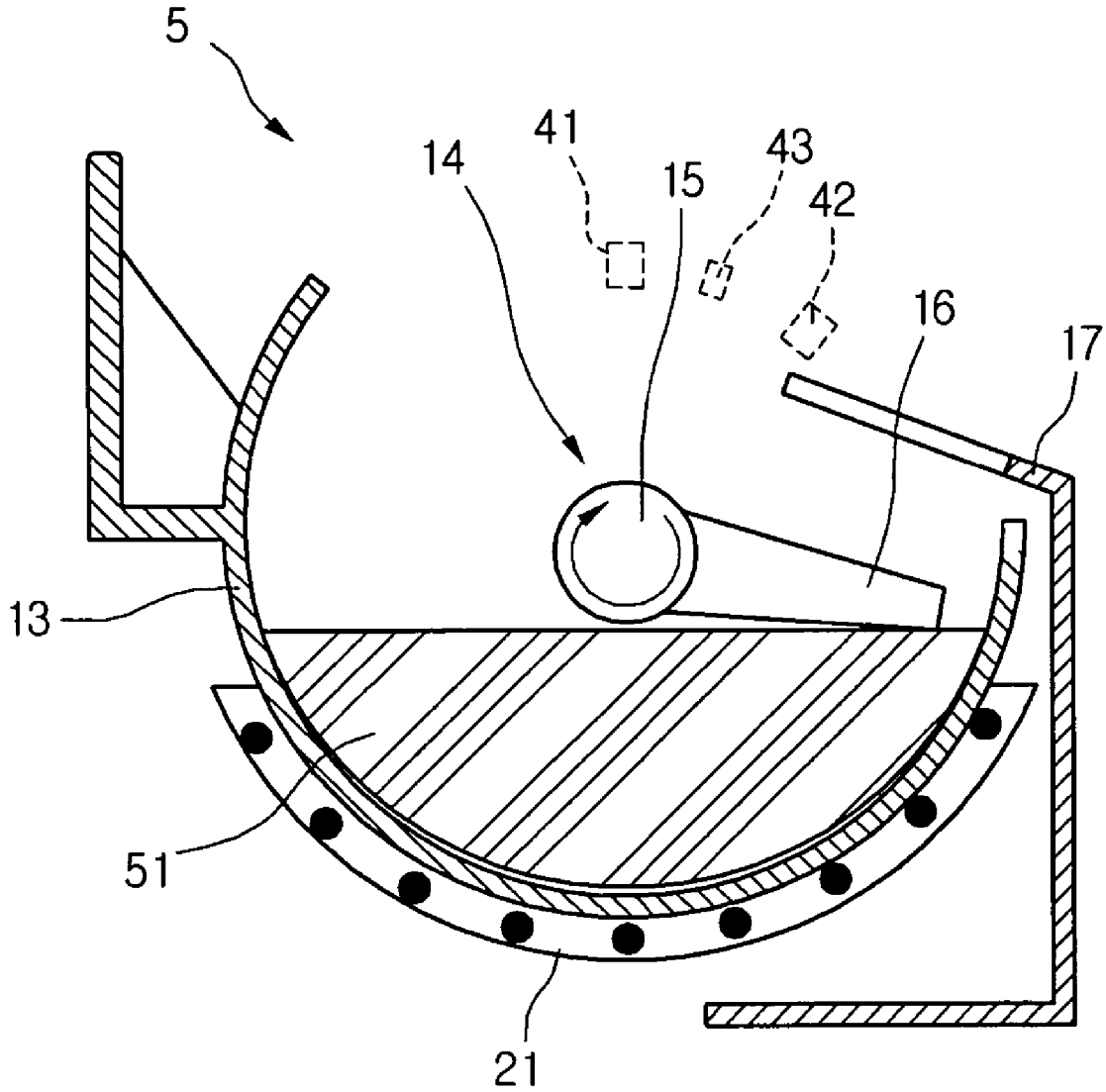
FIG. 8 is a sectional view showing an ice ejecting operation in an ice maker according to the present invention, in which ice is not yet separated from a surface of an ice making portion.
Figure 9:
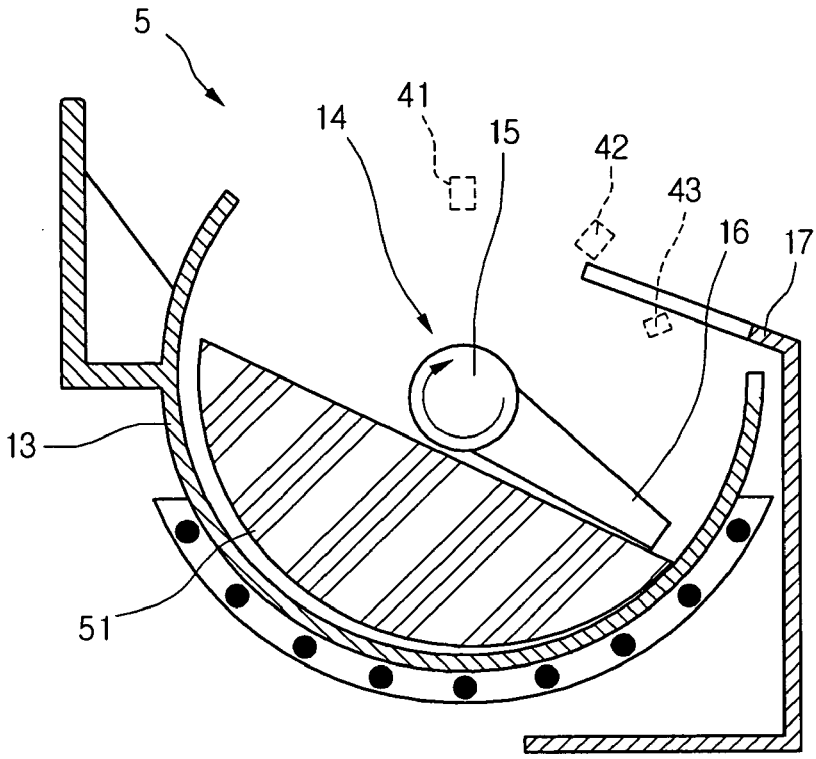
FIG. 9 is a sectional view showing an ice ejecting operation in an ice maker according to the present invention, in which ice is completely separated from a surface of an ice making portion and partially ejected from the ice making portion.

FIG. 7 is a sectional view showing an early stage of ice making operation in an ice maker according to the present invention, FIG. 8 is a sectional view showing an ice ejecting operation in an ice maker according to the present invention, in which ice is not yet separated from a surface of an ice making portion, and FIG. 9 is a sectional view showing an ice ejecting operation in an ice maker according to the present invention, in which ice is completely separated from a surface of an ice making portion and partially ejected from the ice making portion.

Referring to FIG. 7, the first sensor 41 and the sensor detecting portion 43 are aligned with each other and the finger 16 of the ejector 14 is spaced apart from the ice. In these relative positions of the first sensor 41 and the sensor detecting portion 43, an ice making operation is carried out to make an ice block 51 or the heater 21 slightly melt the ice block 51 to separate it from the surface of the ice making portion 13. That is, when this first sensor 41 is aligned with the sensor detecting portion 43, it is considered that an ice making operation or an ice melting operation is being carried out.

Referring to FIG. 8, the finger 16 of the ejector 14 starts to push the ice block 51 after the ice making and melting operations.

Though the time necessary for the heater 21 to separate the ice block 51 from the surface of the ice making portion 13 is proportional to the size of the ice block 51, the controller of the ice maker controls the heating time of the heater 21 using a reference heating time in a memory, which is selected depending on the capacity of the ice maker. Therefore, when the reference heating time is shorter than an actually necessary heating time because of a large amount of water supply, the ice block 51 is not completely separated from the surface of the ice making portion 13, extending a stall situation in which the ice block 51 does not move though the finger 16 of the ejector pushes it.

On the contrary, when the reference heating time is longer that an actually necessary heating time because of a small amount of water supply, the ice block 51 is melted more than is required to be separated from the surface of the ice making portion 13. In this case, the finger 16 pushes out the ice block 51 from the ice making portion 13 as shown in FIG. 9 without the stall situation shown in FIG. 8.

That is, the bigger ice block 51 increases the period of the stall situation (stall time), and on the contrary the smaller ice block 51 decreases the period of the stall situation. The size of the ice block 51 is associated with a water supply rate of a water inlet. Since higher water supply rate (the amount of water supply per unit time) increases the amount of the water supply and lower water supply rate decreases the amount of the water supply, a water supply time must be shortened or extended depending on the water supply rate to properly adjust the amount of the water supply.

Meanwhile, the three positions of the ejector 14 are shown in drawings: FIG. 7 shows the first position at which the first sensor 41 is aligned with the sensor detecting portion 43; FIG. 8 shows the second position at which the sensor detecting portion 43 located between the first and second sensors 41 and 42; and FIG. 9 shows the third position at which the sensor detecting portion 43 is located after the second sensor 42. If the time taken by the ejector 14 to stay at the second position (which is proportional to the stall time of the ejector 14) is long, it is determined that the amount of the water supply is large and therefore the water supply time is shortened to reduce the amount of the water supply.

The adjustment of the water supply time may be carried out by a micro-processor installed in the control box 11. The micro-processor may use an ice making time and a heating time that are stored in a memory to control the ice maker 5. The ice making time stored in the memory may be selected depending on the amount of the water supply, and the heating time stored in the memory may be selected depending on the size of the ice that is made with the supplied water.

Figure 10:
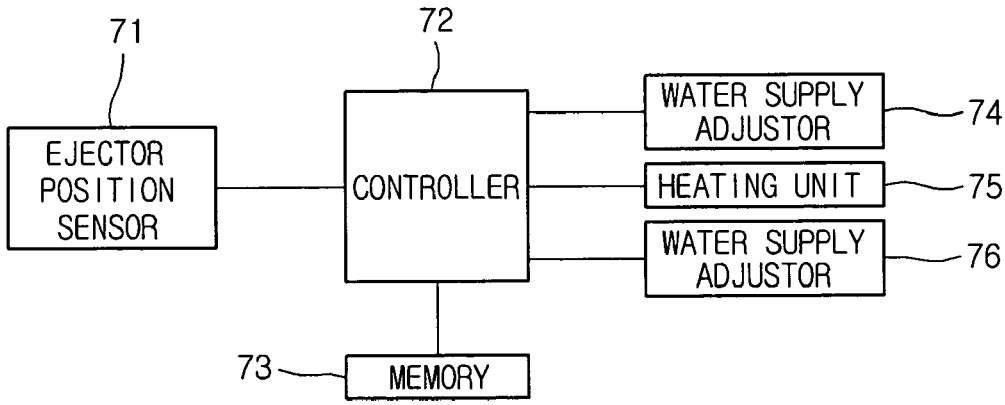
FIG. 10 is a block diagram of a control apparatus for supplying water to an ice maker according to the present invention.

FIG. 10 is a block diagram of a control apparatus for supplying water to an ice maker according to the present invention a water supply control apparatus for an ice maker and method thereof will be described with reference to FIG. 10

A water supply control apparatus for an ice maker includes a memory 73, a controller 72 to control the operation of the ice maker, an ejector position sensor 71 to detect the rotation angle of the sensor detecting portion and the axle 15 and send a resulting sensor signal to the controller 72, and a water supply adjustor 74 to adjust the amount of water supply and a water supply time according to the sensor signal. Also, the water supply control apparatus includes a heating unit 75 provided with the heater 21 to separate ice from the surface of the ice making portion 13 and an ice ejection controller 76 provided with the motor 32 and the ejector 14 to control the ice ejecting operation.

The ejector position sensor 71 may include the first sensor 41, the second sensor 42, and the sensor detecting portion 43.

In operation, the heating unit 75 controls the heater 21 to separate the ice block 51 from the surface of the ice making portion 13 after the ice block 51 is made by applying a cooling air to the water supplied to ice making portion 13. To separate the ice block 51 from the surface of the ice making portion 13, the heater 21 applies heat to the ice making portion 13 for a predetermined time to slightly melt the ice block 51.

Herein, the water supply adjustor 74 may set a water supply time, a cooling air supply time, and a heating time by using reference values stored in the memory 73.

After the heating unit 75 is operated, the ice ejection controller 76 is controlled to rotate the ejector 14. The ejector position sensor 71 detects the rotation angle of the ejector 14 and sends a resulting signal to the controller 72. The controller 72 uses the signal from the ejector position sensor 71 to control the amount of the water supply. After the amount of the water supply is adjusted, above operation is repeated to determined whether the amount of the water supply is properly adjusted or not. The water supply adjustment is repeatedly performed until the amount of the water supply is properly adjusted.

An appropriate amount of water supply may be determined after the water supply adjustment is carried out several times. Then, the amount of water supply is fixed to the appropriate value and the appropriate value is stored in the memory 73. After this, the stored appropriate value is used by the water supply adjustor 74. If necessary, a user can press a water supply control button formed at a control panel of a refrigerator to repeat the water supply adjustment operation again to replace the appropriate value stored in the memory 73 with new one. Also, a volatile memory may be used for the memory 73 to replace the stored appropriate value with new one when the power is turned on again, for example, when the user moves to a new house where the household water source has a different water supply rate.

A water supply control method of the present invention will now be more fully described with reference to the accompanying drawings.

Figure 11:
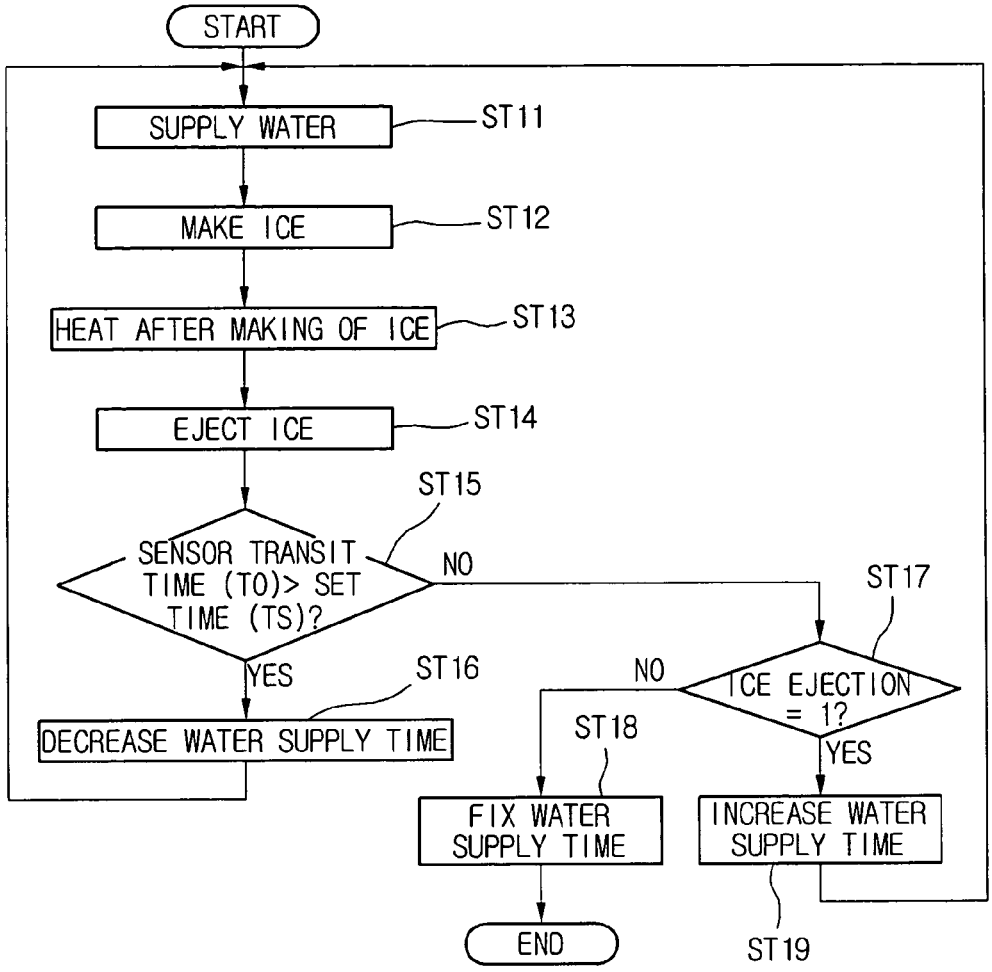
FIG. 11 is a flowchart showing a first embodiment of a water supply control method for an ice maker according to the present invention.
Figure 12:
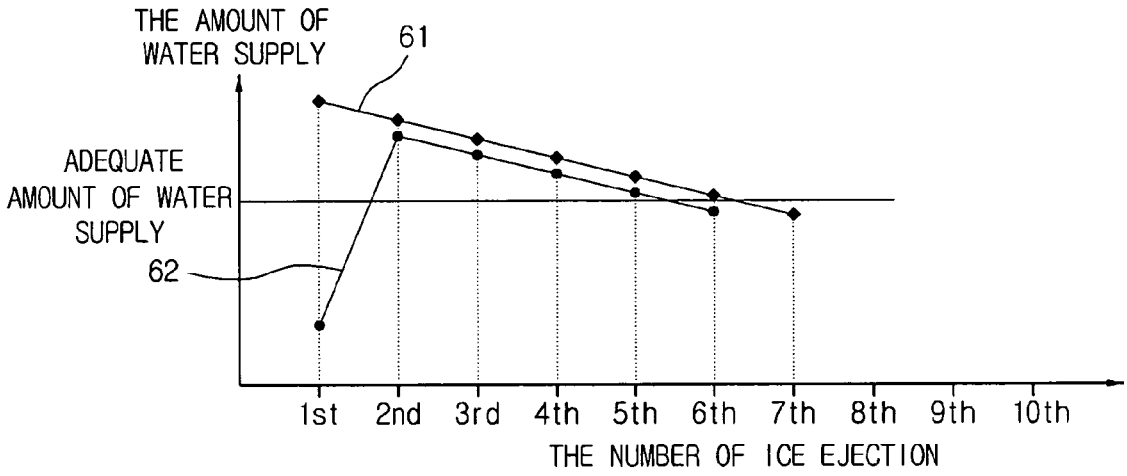
FIG. 12 is a graph showing variation in the amount of supplied water according to a first embodiment of the present invention.

FIG. 11 is a flowchart showing a first embodiment of a water supply control method for an ice maker according to the present invention, and FIG. 12 is a graph showing variation in the amount of supplied water according to a first embodiment of the present invention.

Referring to FIGS. 11 and 12, the operations of supplying water (ST11), making an ice block 51 (ST12), heating the ice block 51 (ST13), and ejecting the ice block 51 (ST14) are sequentially carried out. After operation ST14, the process goes to operation ST16 or operation ST17 via operation ST15.

In operation ST14, the ejector 14 ejects the ice block 51 from the ice making portion 13. If the ice block 51 is not completely separated from the surface of the ice making portion 13 due to insufficient heating in operation ST13, a stall situation (refer to FIG. 8) occurs as the ejector 14 ejects the ice block 51. If the ice block 51 is completely separated, the stall situation does not occur. Since the stall situation occurs when the amount of water supply is large, the water supply time must be shortened. On the contrary, since the stall situation does not occur when the amount of the water supply is appropriate or small, the water supply time must be fixed or extended. Herein, the water is rarely supplied in proper amount at initial operation, it can be determined that the amount of the water supply is small when the stall situation does not occur. Also, since the operational time of the operation of heating the ice block 51 (ST13) is set by a manufacturer according to a type of the ice maker and a reference amount of water supply, the water supply time may be the only factor affecting the operation of ejecting the ice block 51 (ST14).

In operation ST15, it is determined whether a sensor transit time TO is longer than a set time TS during operation ST14 to adjust the water supply time as described above. The sensor transit time TO is a time necessary for the sensor detecting portion 43 to actually pass from the first sensor 41 to the second sensor 42, and the set time TS is a time for the sensor detecting portion 43 to pass from the first sensor 41 to the second sensor 42 without the stall situation. The set time TS is predetermined depending on the type of the motor 32 and the angle between the sensors 41 and 42.

If the sensor transit time TO is longer that the set time TS it is determined that the stall situation occurs, and if not it is determined that the stall situation does not occur.

When the stall situation occurs, the process goes to operation ST16 to reduce the water supply time because the occurrence of the stall situation means that the amount of the water supply is large (the water supply time is long). Then, the process goes back to operation ST11.

When the stall situation does not occur, the process goes to operation ST17 where it is determined whether the ejecting of the ice block 51 is performed once. If so, the process goes to operation ST19 to increase the water supply time and then goes back to operation ST11. Operations ST17 and ST19 are required to increase the amount of the water supply to some degree and then adjust the amount of the water supply by reducing it gradually because it is not known whether the amount of the water supply is appropriate or small when the sensor transit time TO is not longer than the set time TS.

That is, the water supply control method of the present invention is designed such that the amount of the water supply is gradually and repeatedly reduced when the stall situation occurs due to oversupply of the water to eliminate the stall situation and determine an appropriate amount of water supply. For this purpose, the increase time of the water supply in operation ST19 may be much more than the decreased time of the water supply in operation ST16. For example, the water supply time may be set to 7 seconds in operation ST11; the water supply time decrease in operation ST16 may be set to 0.1 seconds; and the water supply time increase in operation ST19 may be set to 3 seconds.

The water supply time adjustment processes are repeated to adjust the amount of the water supply appropriately until it is determined that the sensor transit time TO is not longer than the set time TS in operation ST15. Then, the process goes to operation ST18 via operation ST17. In operation ST18, the water supply time is fixed. The fixed water supply time may be stored in a memory to set the water supply time thereafter.

Referring again to FIG. 12, when the water pressure of a water inlet line is high (when the water supply rate is high), a large amount of water is initially supplied to the ice maker. Therefore, the water supply time is gradually shortened to reduce the amount of the water supply. An oversupply control line 61 shows this control procedure of reducing the amount of the water supply. When the water pressure of the water inlet line is low (when the water supply rate is low), a small amount of water is initially supplied to the ice maker. Therefore, the water supply time is extended one time to some degree in operation ST19 to significantly increase the amount of the water supply, and then the water supply time is gradually shortened to reduce the amount of the water supply. An undersupply control line 62 shows this control procedure.

The oversupply control line 61 and under supply control line 62 may provide a clear understanding of the water supply control method of the present invention. When the water is initially supplied less than an adequate amount of water supply (V1), it is determined that the sensor transit time TO is not longer than the set time TS. Then, the amount of the water supply is significantly increased one time and it is gradually reduced toward the adequate amount of water supply (V1). When the water is initially supplied more than the adequate amount of water supply (V1), it is determined that the sensor transit time TO is longer than the set time TS. Then, the amount of the water supply is gradually reduced toward the adequate amount of water supply (V1).

Though the operation of increasing the water supply time (ST19) is carried out just one time in this embodiment, it may be carried out two or three times. Particularly, when the water supply rate is very low, it may be carried out more than one time.

This embodiment of the present invention may be more useful where the water supply rate varies largely.

Figure 13:
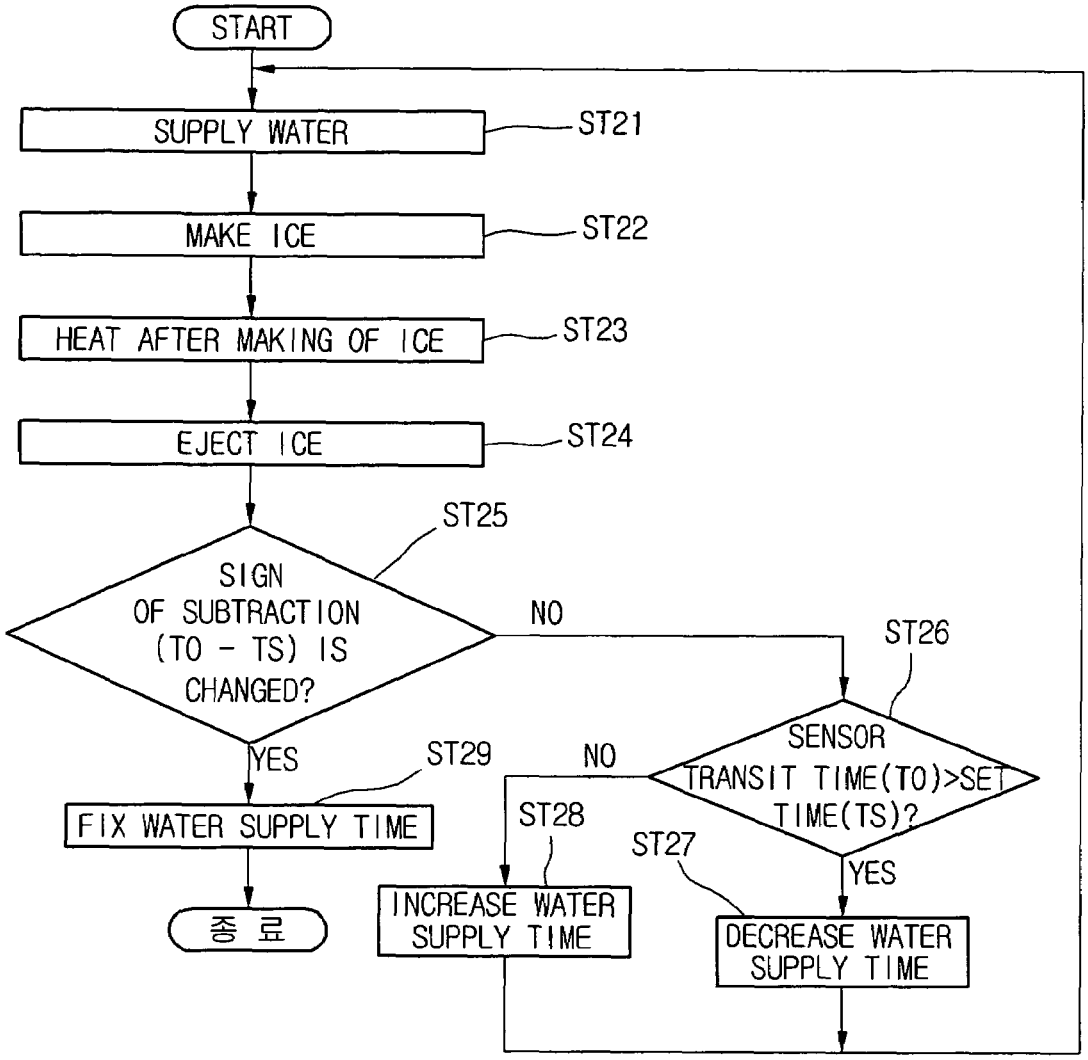
FIG. 13 is a flowchart showing a second embodiment of a water supply control method for an ice maker according to the present invention.
Figure 14:
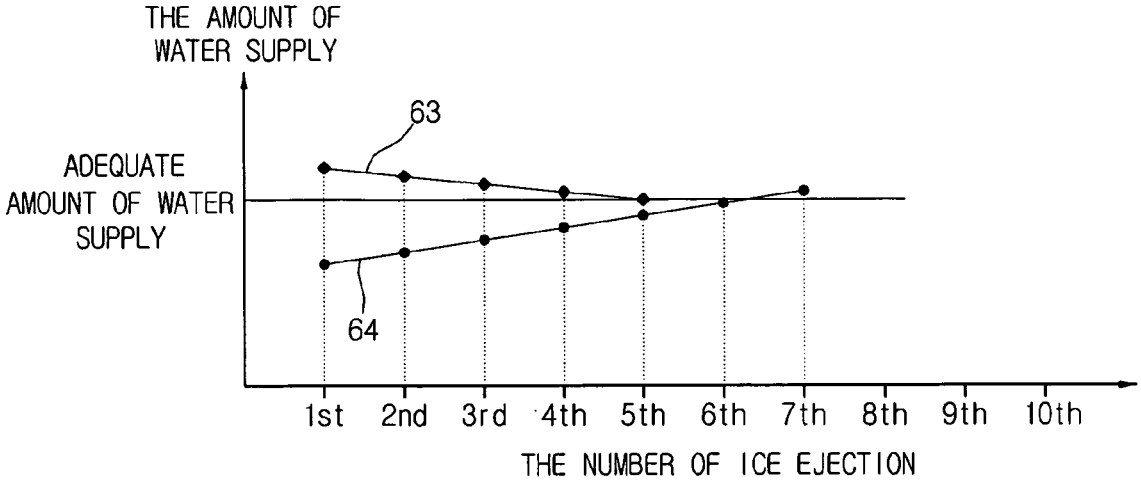
FIG. 14 is a graph showing variation in the amount of supplied water according to a second embodiment of the present invention.

FIG. 13 is a flowchart showing a second embodiment of a water supply control method for an ice maker according to the present invention, and FIG. 14 is a graph showing variation in the amount of supplied water according to a second embodiment of the present invention.

Referring to FIGS. 13 and 14, the operations of supplying water (ST21), making an ice block 51 (ST22), heating the ice block 51 (ST23), and ejecting the ice block 51 (ST24) are sequentially carried out. After operation ST24, the process goes to operation ST26 or operation ST29 via operation ST25.

In operation 25, the sign of a subtraction value obtained by subtracting the set time TS from the sensor transit time TO is compared with the sign of the preceding subtraction value to determine whether the sign is changed or not. For example, if the preceding subtraction value is −0.5 and the current subtraction value is 0 or 0.1, it is determined that the sign of the current subtraction value is changed. Herein, the term "sign" is used to denote whether the subtraction value is negative, zero, or positive. If the sign of the current subtraction value is changed, it is determined that the current amount of the water supply is approached to the adequate amount of water supply (V1) and the process goes to operation ST29. In operation ST29, the current amount of the water supply is fixed and saved. If the sign of the current subtraction value is not changed, the process goes to operation ST26.

In detail, since a positive subtraction value means that the amount of water supply is large, the water supply time must be gradually shortened to reduce the amount of the water supply to reach the adequate amount of water supply (V1). On the contrary, since a non-positive subtraction value means that the amount of the water supply is small, the water supply time must be gradually extended to increase the amount of the water supply to reach the adequate amount of water supply (V1). Therefore, when the sign of the current subtraction value is changed, it is assumed that the current amount of the water supply is closely approached or equal to the adequate amount of water supply (V1). When the sensor transit time TO and the set time TS is equal, the subtraction vale is zero. However, since it is rare that the subtraction vale is zero, the sign of the subtraction value may be changed from negative to positive or positive to negative in most cases.

Merely, when operation ST25 is carried out for the first time, the process only goes to operation ST26 regardless of the determination of operation ST25 to adjust the water supply time at least one time. Therefore, the sign of the subtraction value can be compared with the sign of the preceding subtraction value.

In operation ST26, it is determined whether the sensor transit time TO is longer than the set time TS. If the sensor transit time TO is longer that the set time TS, it is determined that the stall situation occurs and the process goes to operation ST27 to decrease the water supply time. If not it is determined that the stall situation does not occur the process goes to operation ST28 to increase the water supply time. The decrease time and increase time in operations ST27 and ST28 may affect the precision of the adjustment result of the amount of the water supply. For example, the decrease time and increase time may be equally set to 0.1 seconds.

After the water supply time is changed in operations ST27 or ST28, the process goes back to operation ST21 for repetition. During the repetition, if the sign of the subtraction value is changed when compared with the sign of the preceding subtraction value, the amount of the water supply is fixed (ST29) and the process ends.

Referring again to FIG. 14, when the water pressure of a water inlet line is high (when the water supply rate is high), a large amount of water is initially supplied to the ice maker. Therefore, the water supply time is gradually shortened while repeating operation ST27 to reduce the amount of the water supply. An oversupply control line 63 shows this control procedure of reducing the amount of the water supply. When the water pressure of the water inlet line is low (when the water supply rate is low), a small amount of water is initially supplied to the ice maker. Therefore, the water supply time is gradually extended while repeating operation ST28 to increase the amount of the water supply. An undersupply control line 64 shows this control procedure.

When the water is initially supplied less than an adequate amount of water supply (V1), it is determined that the sensor transit time TO is not longer than the set time TS. Then, the amount of the water supply is gradually increased toward the adequate amount of water supply (V1) as like the undersupply control line 64. When the water is initially supplied more than the adequate amount of water supply (V1), it is determined that the sensor transit time TO is longer than the set time TS. Then, the amount of the water supply is gradually reduced toward the adequate amount of water supply (V1) as like the oversupply control line 63. In the oversupply control line 63, the amount of the water supply reaches the adequate amount of water supply (V1) when the water supply time is gradually shortened five times (when the ice ejection is carried out five times). Also, in the undersupply line 64, the amount of the water supply reaches the adequate amount of water supply (V1) when the water supply time is gradually increased seven times (when the ice ejection is carried out seven times).

This embodiment of the present invention may be more useful where the water supply rate varies not so much.

As described above, the amount of the water supply and the water supply time can be automatically adjusted without manual operation, increasing user's convenience.

Further, if necessary the adjustment of the water supply can be revised anytime.

Particularly, the size of the ice can be automatically adjusted even when the water supply rate is changed due to house-moving or other reasons, such that the user can use the ice maker more conveniently.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A water supply control apparatus for an ice maker, comprising:

an ice making portion in which ice is made;

an ejector rotatably installed to eject the ice;

at least one pair of sensors detecting the angle of the ejector; and a controller controlling the amount of water supplied to the ice making portion in accordance with a sensor transit time necessary for the ejector to pass the distance between the pair of sensors.

2. The water supply control apparatus according to claim 1, further comprising a heater to separate the ice from a surface of the ice making portion.

3. The water supply control apparatus according to claim 1, wherein the sensors are non-movably fixed to a control box.

4. The water supply control apparatus according to claim 1, wherein the ejector is formed with a sensor detecting portion which is detected by the sensors.

5. The water supply control apparatus according to claim 1, wherein the sensors are hole sensors, and the ejector is formed with a sensor detecting portion made of magnet which is detected by the sensors.

6. The water supply control apparatus according to claim 1, wherein the ice maker is installed at a refrigerator door.

7. The water supply control apparatus according to claim 1, wherein when the ejector passes the distance between the sensors, a stall situation occurs.

8. The water supply control apparatus according to claim 1, wherein the amount of the water supply to the ice making portion is controlled to be reduced when the sensor transit time is longer than a set time, and the amount of the water supply to the ice making portion is controlled to be increased when the sensor transit time is not longer than the set time.

9. A water supply control apparatus for an ice maker, comprising:

an ice ejection controller including at least one ejector to push ice;

an ejector position sensor including at least two sensors to detect the rotation position of the ejector;

a water supply adjustor adjusting the amount of water supply to the ice maker; and a controller determining whether a stall situation occurs when the ejector operates by using a sensor transit time for the ejector to move from one of the two sensors to the other, and the controller controlling the water supply adjustor to reduce the amount of the water supply when the stall situation occurs and to increase the amount of the water supply when the stall situation does not occur.

10. The water supply control apparatus according to claim 9, wherein the controller determines that the stall situation occurs when the sensor transit time is longer than a set time.

11. The water supply control apparatus according to claim 10, wherein if the ice is ejected more than certain times and the sensor transit time is not longer than the set time, the controller determines that the current amount of the water supply is adequate.

12. The water supply control apparatus according to claim 10, wherein the controller determines the amount of the water supply is adequate when occurrence of the stall situation is changed during repetition of ice ejecting operation.

* * * * *